US007393267B2

(12) United States Patent
Dummermuth-Furter

(10) Patent No.: US 7,393,267 B2
(45) Date of Patent: Jul. 1, 2008

(54) FLOOR SANDING MACHINE

(75) Inventor: Ruedi Dummermuth-Furter, Thurnen (CH)

(73) Assignee: Airtec AG, Zunzgen (CH)

( * ) Notice: Subject to any disclaimer, the term of this patent is extended or adjusted under 35 U.S.C. 154(b) by 0 days.

(21) Appl. No.: 11/651,634

(22) Filed: Jan. 8, 2007

(65) Prior Publication Data

US 2007/0184762 A1 Aug. 9, 2007

(30) Foreign Application Priority Data

Jan. 10, 2006 (CH) ..... 0033/06

(51) Int. Cl.
*B24B 23/02* (2006.01)

(52) U.S. Cl. ..... 451/353; 451/350; 15/49.1

(58) Field of Classification Search ..... 15/49.1, 15/50, 50.2, 52.2, 98; 451/350, 351, 352, 451/353; 474/8, 84, 101, 139, 148, 149
See application file for complete search history.

(56) References Cited

U.S. PATENT DOCUMENTS 835,631 A 11/1906 Mooney et al.
3,354,488 A * 11/1967 Bilde ..... 15/49.1
4,459,123 A * 7/1984 Tatsunaka et al. ..... 474/87
4,483,128 A * 11/1984 Hawkins ..... 56/11.1
4,862,548 A * 9/1989 Sergio ..... 15/49.1
5,377,375 A * 1/1995 Holman et al. ..... 15/49.1
5,637,032 A * 6/1997 Thysell et al. ..... 451/259
5,885,139 A * 3/1999 Lemieux et al. ..... 451/69
6,331,138 B1 12/2001 Witters et al.
6,540,596 B1 * 4/2003 Van Der Veen ..... 451/350
6,783,447 B2 * 8/2004 Van Vliet et al. ..... 451/353
6,830,524 B2 * 12/2004 Tamai ..... 474/134
7,140,957 B2 * 11/2006 Thysell et al. ..... 451/350
7,226,347 B1 * 6/2007 Padgett et al. ..... 451/353
7,241,210 B2 * 7/2007 Van Vliet ..... 451/353
7,261,623 B1 * 8/2007 Palushi ..... 451/350

* cited by examiner

*Primary Examiner*—Timothy V Eley
(74) *Attorney, Agent, or Firm*—Tarolli, Sundheim, Covell & Tummino LLP

(57) ABSTRACT

A floor sanding machine is proposed, which consists of a case body (11) and a plurality of sanding tools (30) arranged eccentrically in the case body (11). The axes of the tool shafts (31) rotate about the axis of a central shaft (12), and the sanding tools (30) rotate about the axis of the tool shaft. The construction consists essentially of a belt drive, of which the unilaterally grooved drive belt (3) is driven on the grooved side of the main drive pulley (2) and drives a gear mechanism (5). Also on the grooved side of the drive belt (3), a belt tensioner (6) ensures that the drive belt (3) is always under sufficient tension. The tools (4) are driven via the non-grooved side of the drive belt (3).

3 Claims, 4 Drawing Sheets

FLOOR SANDING MACHINE

CROSS-REFERENCE TO RELATED APPLICATION

This application claims priority from Swiss Patent Application No. CH 00033/06, filed Jan. 10, 2006, the subject matter of which is incorporated herein by reference.

FIELD OF THE INVENTION

The present invention relates to a floor sanding machine according to the preamble to Patent-claim 1.

BACKGROUND OF THE INVENTION

Floor sanding machines according to the preamble to the first patent claim have already been familiar for decades and are proven in service. A good example of the early recognition of such technology and its advantages can be found in patent number U.S. Pat. No. 835,631 dating from the year 1905.

The re-examination of this technology towards the end of the twentieth century led to an abundance of patent applications followed by the granting of patents. Accordingly, it appears appropriate to the applicant to submit patent applications in respect of inventions made in the course of research and considered to be relevant: U.S. Pat. No. 6,783,447; U.S. Pat. No. 5,637,032; U.S. Pat. No. 6,540,596 and U.S. Pat. No. 6,331,138. This list is not exhaustive, although it contains the specifications that are considered important.

The present specifications reveal clear disadvantages. In the case of U.S. Pat. No. 6,783,447, for example, the fact that three belt drives are used is disadvantageous, due to the requirement for more space, as a consequence of which the device is ungainly. In addition, the gear mechanism is arranged eccentrically as additional weight and as such generates an imbalance in the device that is disadvantageous for the sanding process. Imbalance in a device of this kind always produces a one-sided application of force to the sanding tools, which manifests itself when operating such a device in the machine "drifting to one side" and having to be restrained against this tendency to "swing out". A further disadvantage associated with the static, eccentric loading of the sanding tools relates to the sanding process. Depending on their individual position, the sanding tools are subjected to more or less weight, which also reveals itself in an uneven sanding pattern. These disadvantages are also exhibited by U.S. Pat. No. 6,540,596, which operates with two drive motors.

A different situation applies in the case of U.S. Pat. No. 5,637,032. The flat belt, which is depicted in FIG. 2*b* as passing around both the large pulley and the small tool driving pulleys, is under high tension. Its replacement presents a very considerable risk of accident to the persons involved. A further disadvantage, which is compensated for in part by an increased tension in this particular flat belt, is the exceptionally small angle of belt contact of the sanding tool drive shafts 8*c*.

Devices that are constructed according to the design principles described above are available on the market and are also sold. They are affected by the shortcomings outlined above.

The present invention has as its object the improvement of a floor sanding device of the kind mentioned by way of introduction, in such a way that the advantages of the previously disclosed floor sanding machines are retained, but that the device is more easily operated, the mechanical drive components are reliably protected against contamination by dirt, and repair and maintenance operations can be carried out simply and without the risk of accident to the personnel.

This object is achieved by a floor sanding machine having the characterizing features of Patent claim 1. Further characterizing features in accordance with the invention can be appreciated from the dependent claims, and their advantages are explained in the following description.

The figures depict preferred proposed embodiments, which are explained as examples in the following description.

DETAILED DESCRIPTION OF THE INVENTION

Figure 4:
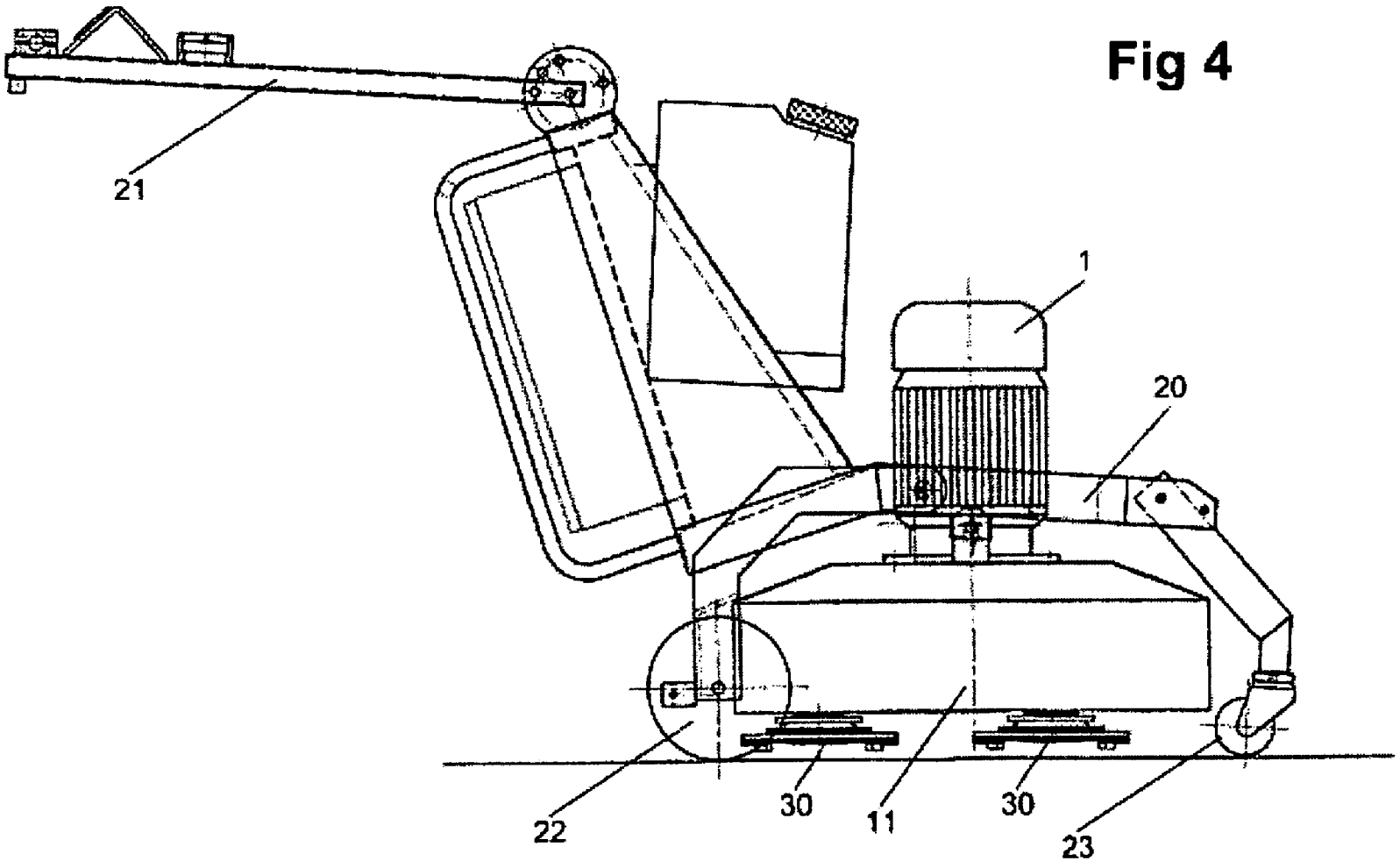
FIG. 4 shows a view of the floor sanding machine

A floor sanding machine (FIG. 4) of the kind proposed according to the invention always consists of a frame 20, which is equipped with a handle 21 and with pulleys 22 and rollers 23. The rollers 23 serve only for the transport of the floor sanding machine and can be raised for the sanding process by means of a hydraulic arrangement on the handle, while the pulleys 22 serve as a guiding means and weight support means for the person who is operating the floor sanding machine during the sanding process.

The parts that are important for the operating process are the drive 1, the case body 11 and the sanding tools 30. These parts are supported by the frame 20. The drive 1 is rigidly attached to the frame 20. The case body 11 is supported in the frame 20 so that it is able to rotate. The tool axes 31 of the sanding tools 30 are arranged eccentrically but on the same radius inside this rotating case body 11. All the tool axes 31 are rotatably mounted in the case body 11.

Figure 1:
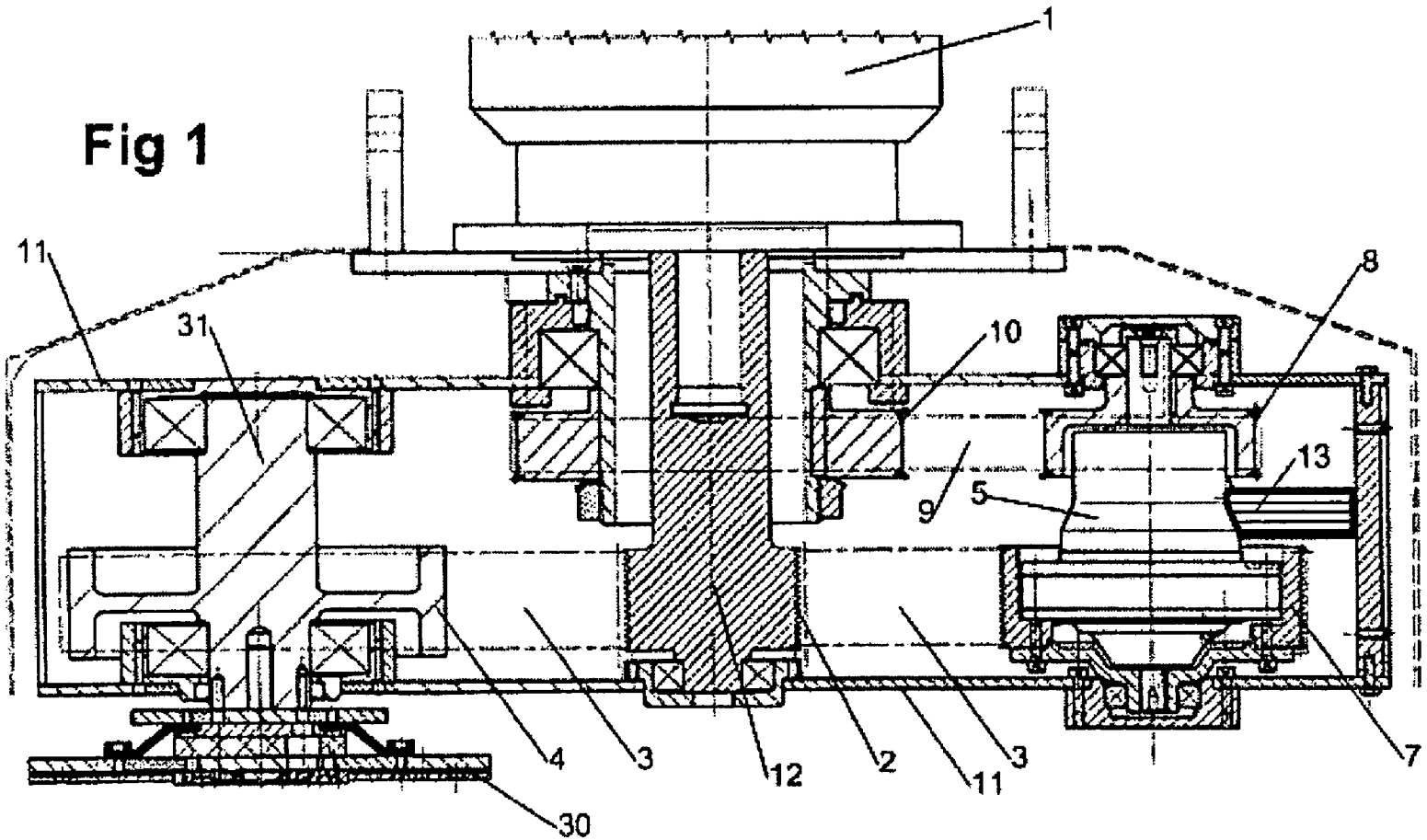
FIG. 1 shows a section through the floor sanding machine.
Figure 2:
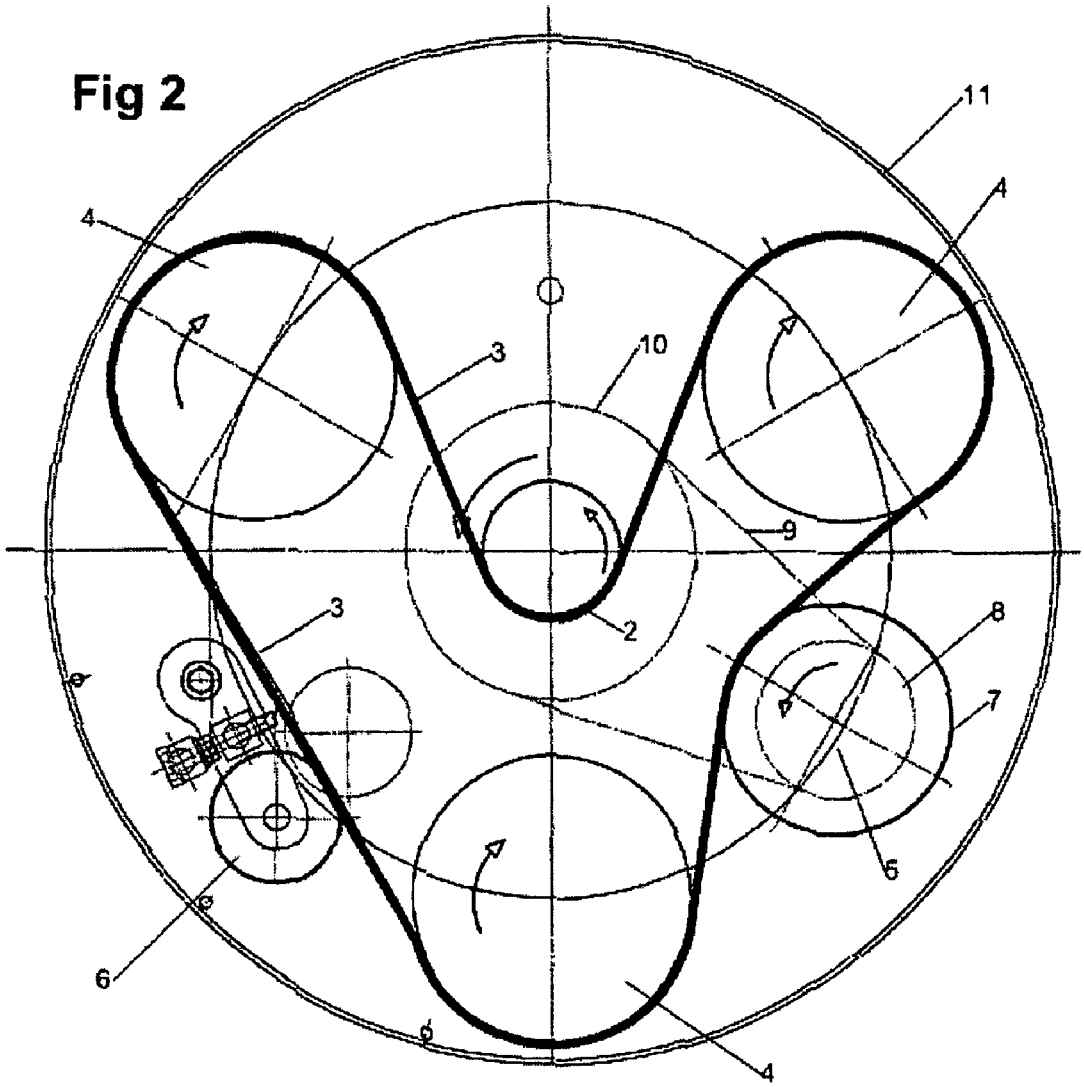
FIG. 2 shows a top view of the drive for the tools.
Figure 3:
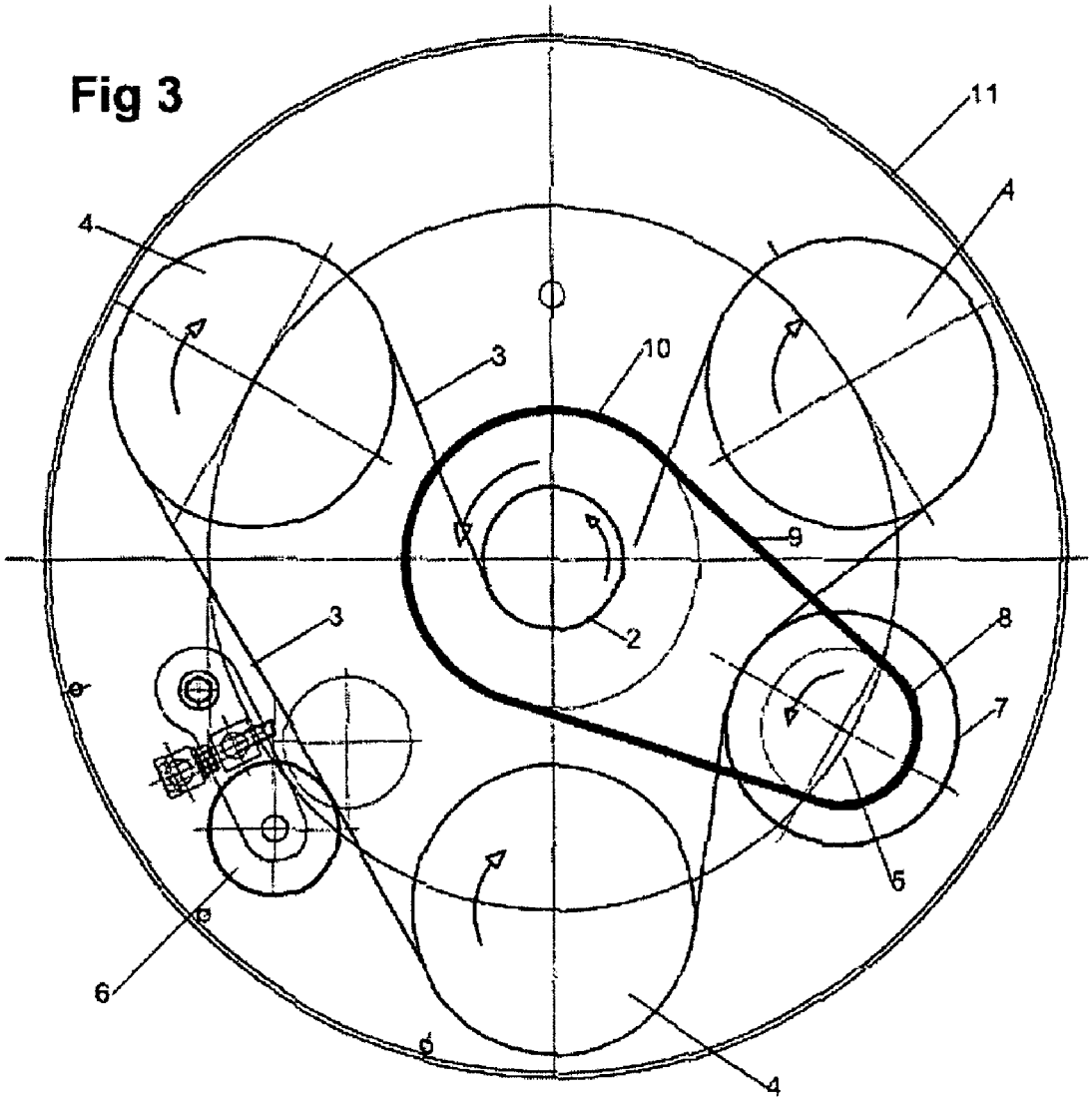
FIG. 3 shows a top view of the drive for the case body.

The drive for the unit is assured by the drive 1 that is rigidly attached to the frame 20 (FIG. 1 and FIG. 2). The drive 1 can be an electric motor, a petrol engine, a diesel engine or a drive element powered by some other form of energy. A main drive pulley 2 is rigidly attached to the central shaft 12, the extension of the drive shaft of the drive 1. This main drive pulley 2 drives a unilaterally grooved drive belt 3. The raised areas of the longitudinal grooves on the periphery of the main drive pulley 2 engage in the recesses in the drive belt 3 in such a way that the drive belt 3 is unable, for as long as it is maintained under a certain tension, to slide off laterally from the main drive pulley 2. The drive belt 3 utilizes the same kind of contact to drive the gear mechanism drive pulley 7. The tension is maintained by the so-called belt tensioner 6, which itself exhibits the same grooving. The main drive pulley 2, the gear mechanism drive pulley 7 and the belt tensioner 6 thus ensure that the unilaterally, longitudinally grooved drive belt 3 does not slide off laterally, even though the gravitational force acting upon it could cause this to occur. The longitudinal grooves in the drive belt 3 thus engage in the longitudinal grooves of the main drive pulley 2, the gear mechanism drive pulley 7 and the belt tensioner 6.

The sanding tools 30 are driven with the non-grooved rear side of the drive belt 3. The drive belt 3 drives the tool drive pulleys 4, which are rigidly attached to the tool shafts 31. The angle of belt contact of the tool drive pulleys 4 is extraordinarily large in this design, which ensures optimal power transmission. In spite of this, the choice of a unilaterally grooved drive belt 3, the other side of which is flat, also offers the possibility of providing the sanding tool 30 with a certain slippage at a very high resistance. This function acts like a slip clutch, which only operates in an emergency but does not cause any damage in the event of it slipping.

Both the tool shafts 31 of the sanding tools 30 and the axes of the gear mechanism 5 are retained and supported rotatably in the case body 11 (FIG. 1). They rotate together with the case body 11 about the central shaft 12. The case of the gear mechanism 5 is prevented from rotating by a torque arm 13, which bears against the case body 11 (FIG. 1). In this way, the speed of rotation introduced via the gear mechanism drive pulley 7 can be transmitted via the gear mechanism 5 and transferred to the gear mechanism output pulley 8. A so-called CYCLO gear mechanism is used in order to permit this transmission to be accommodated in the very small available space.

The gear mechanism output pulley 8 and the toothed belt pulley 10 are connected via a toothed belt 9. The toothed belt pulley 10 is securely attached to the frame 20 of the floor sanding machine. As a result, the rotation of the gear mechanism output pulley 8 causes the gear mechanism 5 that is supported on the case body 11 by means of the torque arm 13 to rotate about the toothed belt pulley 10 and thus about the axis of the central shaft 12. The fact that the gear mechanism 5 is secured to the case body 11 causes the latter to be brought into rotation. The axes of the tool shafts 31, which are also secured to the case body, are carried along. The sanding tools 30 thus also rotate about the axis of the central shaft 12 together with the case body 11, which is crucial for the sanding process. The order of magnitude of this rotation is determined by the transmission built into the gear mechanism 5. The gear mechanism 5 accompanies the rotational movement of the case body 11, so that its weight causes a rotating displacement of the centre of gravity that is positioned eccentrically by the gear mechanism 5.

The drive unit as a whole is effectively protected by the case body 11 against dirt and other external influences. The unit is very compact in this way, and the floor sanding machine is rather more manageable thanks to this constructive solution.

An effort is made to achieve the following speeds of rotation for these floor sanding machines:

| | |
|---|---|
| Central shaft 12 | 1,500 or 3,000 rpm |
| Sanding tools 30 | 500 to 1,000 rpm |
| Case 11 | 30 to 80 rpm |

The diameters of the main drive pulley 2, the gear mechanism drive pulley 7, the tool drive pulley 4, the gear mechanism output pulley 8 and the toothed belt pulley, as well as the transmission of the Cyclo gear mechanism 5, must be designed accordingly.

The invention claimed is:

1. Floor sanding machine having a case body (11) and a plurality of sanding tools (30) arranged eccentrically in the case body (11) with tool shafts (31), in conjunction with which the axes of the tool shafts (31) are rotatably mounted about the axis of a central shaft (12) and the sanding tools (30) are rotatably mounted about the axis of the tool shaft (31), wherein the drive shaft of a drive (1) is rigidly connected via a central axis (12) to a main drive pulley (2), the main drive pulley (2) being maintained in positive engagement by means of a unilaterally and longitudinally grooved drive belt (3) with a gear mechanism drive pulley (10), tool drive pulleys (4) and a belt tensioner (6), the positive engagement being effected on the main drive pulley (2), the gear mechanism drive pulley (7) and the belt tensioner (6) via the side of the drive belt (3) provided with longitudinal grooves, and the positive engagement on the tool drive pulleys (4) being effected via the non-grooved rear side of the drive belt (3).

2. Floor sanding machine according to claim 1, wherein a gear mechanism (5) connected to the gear mechanism drive pulley (7) is a Cyclo gear mechanism, and in that this gear mechanism (5) is retained and supported rotatably in the case body (11), the case body of the gear mechanism (5) being prevented from rotating by a torque arm (13) bearing against the case body (11).

3. Floor sanding machine according to claim 1, wherein a gear mechanism output pulley (8) is in positive and non-positive engagement via a toothed belt (9) with a toothed belt pulley (10), and in that the toothed belt pulley (10) is securely attached to or frame (20).

* * * * *